US009060592B2

(12) United States Patent
Brosius

(10) Patent No.: US 9,060,592 B2
(45) Date of Patent: Jun. 23, 2015

(54) WATER BOTTLE WITH POPPET VALVE

(71) Applicant: Specialized Bicycle Components, Inc., Morgan Hill, CA (US)

(72) Inventor: Mark Brosius, Phoenix, AZ (US)

(73) Assignee: SPECIALIZED BICYCLE COMPONENTS, INC., Morgan Hill, CA (US)

( * ) Notice: Subject to any disclaimer, the term of this patent is extended or adjusted under 35 U.S.C. 154(b) by 0 days.

(21) Appl. No.: 13/687,808

(22) Filed: Nov. 28, 2012

(65) Prior Publication Data

US 2014/0144870 A1 May 29, 2014

(51) Int. Cl.

| | |
|---|---|
| ***B65D 47/24*** | (2006.01) |
| ***A47G 19/22*** | (2006.01) |
| ***A45F 3/18*** | (2006.01) |
| ***B65D 47/20*** | (2006.01) |
| ***B65D 47/06*** | (2006.01) |
| ***A61J 11/00*** | (2006.01) |

(52) U.S. Cl.

CPC ..... *A45F 3/18* (2013.01); *A47G 19/2272* (2013.01); *B65D 47/2031* (2013.01); *B65D 47/06* (2013.01); *A61J 11/002* (2013.01); *B65D 47/247* (2013.01)

(58) Field of Classification Search

CPC .. A45F 3/16; B65D 47/243; B65D 2251/205; B65D 47/2031; B65D 47/06; A47G 19/2272; A61J 11/002

USPC ..... 220/254.9, 714, 717; 215/311, 388, 215/387, 389, 11.4; 222/522, 525, 559, 222/524, 563

See application file for complete search history.

(56) References Cited

U.S. PATENT DOCUMENTS 3,294,294 A * 12/1966 Amburgey ..... 222/525
3,521,796 A * 7/1970 Roy ..... 222/525

(Continued)

FOREIGN PATENT DOCUMENTS

| | | |
|---|---|---|
| CA | 2227888 | 2/1997 |
| CN | 1207084 | 2/1997 |

OTHER PUBLICATIONS

'Modulus of Elasticity—Young Modulus for some common Materials'. The Engineering Toolbox. 2013. (http://www.engineeringtoolbox.com/young-modulus-d_417.html).*

*Primary Examiner* — Fenn Mathew
*Assistant Examiner* — James N Smalley
(74) *Attorney, Agent, or Firm* — Michael Best & Friedrich LLP

(57) ABSTRACT

A liquid-dispensing container includes a housing and a poppet mounted to the housing and movable along an axis between an open position and a closed position. The poppet includes a base portion comprising a relatively rigid material and an elastomeric portion comprising an elastomeric material having a tensile elastic modulus less than the elastic modulus of the rigid material. The elastomeric portion can include an outer section engaged with an outer surface of the base portion and an inner section integrally formed with the outer section and forming a self-closing valve. In one construction, the self-closing valve includes a cylindrical section having a tapered wall thickness. Preferably, the outer section includes a circumferential seal (e.g., a groove) and a circumferential clearance adjacent the circumferential seal. The outer section can further include a retention cleat having a retention surface at an acute angle relative to the axis.

19 Claims, 5 Drawing Sheets

(56) References Cited

U.S. PATENT DOCUMENTS

| | | | | |
|---|---|---|---|---|
| 3,738,545 | A * | 6/1973 | Roy | 222/525 |
| 4,961,888 | A | 10/1990 | Brown | |
| 4,991,745 | A | 2/1991 | Brown | |
| 5,033,655 | A | 7/1991 | Brown | |
| 5,193,264 | A | 3/1993 | Brown | |
| 5,213,236 | A | 5/1993 | Brown et al. | |
| 5,339,995 | A | 8/1994 | Brown et al. | |
| 5,377,877 | A | 1/1995 | Brown et al. | |
| 5,409,144 | A | 4/1995 | Brown | |
| 5,439,143 | A | 8/1995 | Brown et al. | |
| 5,839,614 | A | 11/1998 | Brown | |
| 6,079,594 | A | 6/2000 | Brown et al. | |
| 6,273,296 | B1 | 8/2001 | Brown | |
| 6,279,783 | B1 | 8/2001 | Brown et al. | |
| H02027 | H | 6/2002 | Brown et al. | |
| 6,427,874 | B2 | 8/2002 | Brown et al. | |
| 6,450,375 | B1 | 9/2002 | Hins et al. | |
| 6,523,711 | B1 | 2/2003 | Hughes et al. | |
| 6,749,092 | B2 | 6/2004 | Olechowski et al. | |
| 6,769,577 | B1 | 8/2004 | Feierabend | |
| 6,827,241 | B2 | 12/2004 | Bouzaglo | |
| 7,077,296 | B2 | 7/2006 | Brown et al. | |
| 7,077,742 | B2 | 7/2006 | Stevenson et al. | |
| 7,086,572 | B2 | 8/2006 | Socier et al. | |
| RE39,520 | E | 3/2007 | Hess, III et al. | |
| 7,784,652 | B2 | 8/2010 | Gaus et al. | |
| 8,016,507 | B2 | 9/2011 | Wright | |
| 8,079,385 | B2 | 12/2011 | Hatton | |
| 2001/0025862 | A1 | 10/2001 | Brown et al. | |
| 2002/0179616 | A1 * | 12/2002 | Elder | 220/714 |
| 2005/0211735 | A1 | 9/2005 | Socier et al. | |
| 2006/0037975 | A1 | 2/2006 | Suffa | |
| 2006/0138179 | A1 | 6/2006 | Suffa | |
| 2007/0029334 | A1 | 2/2007 | Bagley | |
| 2008/0110933 | A1 | 5/2008 | Goncalves | |
| 2008/0230569 | A1 | 9/2008 | McConville et al. | |
| 2008/0237271 | A1 | 10/2008 | Olechowski | |
| 2008/0237278 | A1 | 10/2008 | Gaus et al. | |
| 2008/0264979 | A1 | 10/2008 | Nijland et al. | |
| 2008/0310770 | A1 | 12/2008 | Turvey et al. | |
| 2009/0212078 | A1 | 8/2009 | Gaus | |
| 2010/0012686 | A1 * | 1/2010 | Joehnk et al. | 222/525 |
| 2010/0116371 | A1 | 5/2010 | Gaus | |
| 2010/0180971 | A1 | 7/2010 | Hatton | |
| 2012/0248056 | A1 * | 10/2012 | Fischer et al. | 215/11.4 |
| 2012/0273521 | A1 * | 11/2012 | Wu | 222/153.14 |

* cited by examiner

WATER BOTTLE WITH POPPET VALVE

BACKGROUND

The present invention relates generally to water bottles commonly used by cyclists for rehydration, and more specifically to poppet-style valves for such water bottles.

Water bottles are commonly used by athletes and others to hold and dispense liquids, such as water and sports drinks. Water bottles commonly include a body, a cap, and a valve that is movable relative to the cap between open and closed positions. In the open position, liquid can be dispensed from the bottle, and in the closed position, liquid is inhibited from being dispensed from the bottle.

Water bottles valves are frequently in the form of poppet valves including a poppet that can be slid between open and closed positions. Such poppets usually include an engagement portion that facilitates engagement by the user to facilitate opening the valve. In addition to providing a valve function from sliding the poppet between the open and closed positions, some poppets include an additional valve that inhibits the leakage of liquid when the poppet is open. For example, the poppet can include a flexible, self-closing valve, such as the valve disclosed in U.S. Pat. No. 7,784,652, which is hereby incorporated by reference in its entirety. These self-closing valves are commonly secured over an opening in a cap to inhibit flow of liquid from the water bottle.

SUMMARY

A liquid-dispensing container comprising a housing (e.g., a body and a cap) adapted to hold a liquid and a poppet mounted to the housing and movable along an axis between an open position and a closed position. The poppet comprises a base portion comprising a relatively rigid material and an elastomeric portion comprising an elastomeric material having a tensile elastic modulus less than 80% (e.g., less than 50%, 25%, 10%, and most preferably less than 1%) of the elastic modulus of the rigid material. The base portion preferably comprises a tubular structure having an exterior surface that is at least partially covered by the elastomeric material and an interior surface that is at least partially exposed (e.g., at least 50% exposed and preferably at least 75% exposed). Preferably, the base portion has a length that is at least 50% (at least 70%, 85%, and most preferably about 95%) of the length of the poppet.

In one embodiment, the elastomeric portion includes an outer section engaged with an outer surface of the base portion and an inner section integrally formed with the outer section and forming a self-closing valve. In one construction, the self-closing valve includes a cylindrical section having a tapered wall thickness. Preferably, the outer section includes a circumferential seal and a circumferential clearance adjacent the circumferential seal. For example, the circumferential clearance can comprise a groove extending at least 50% through a thickness of the outer section. The circumferential seal can be positioned adjacent a lower end of the base portion, and the outer section can further include a second circumferential seal positioned adjacent a mid portion of the base portion. The outer section can further include an upper protrusion that engages an upper edge of the housing when the poppet is in the open position. The outer section can further include a retention cleat having a retention surface at an acute angle relative to the axis.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
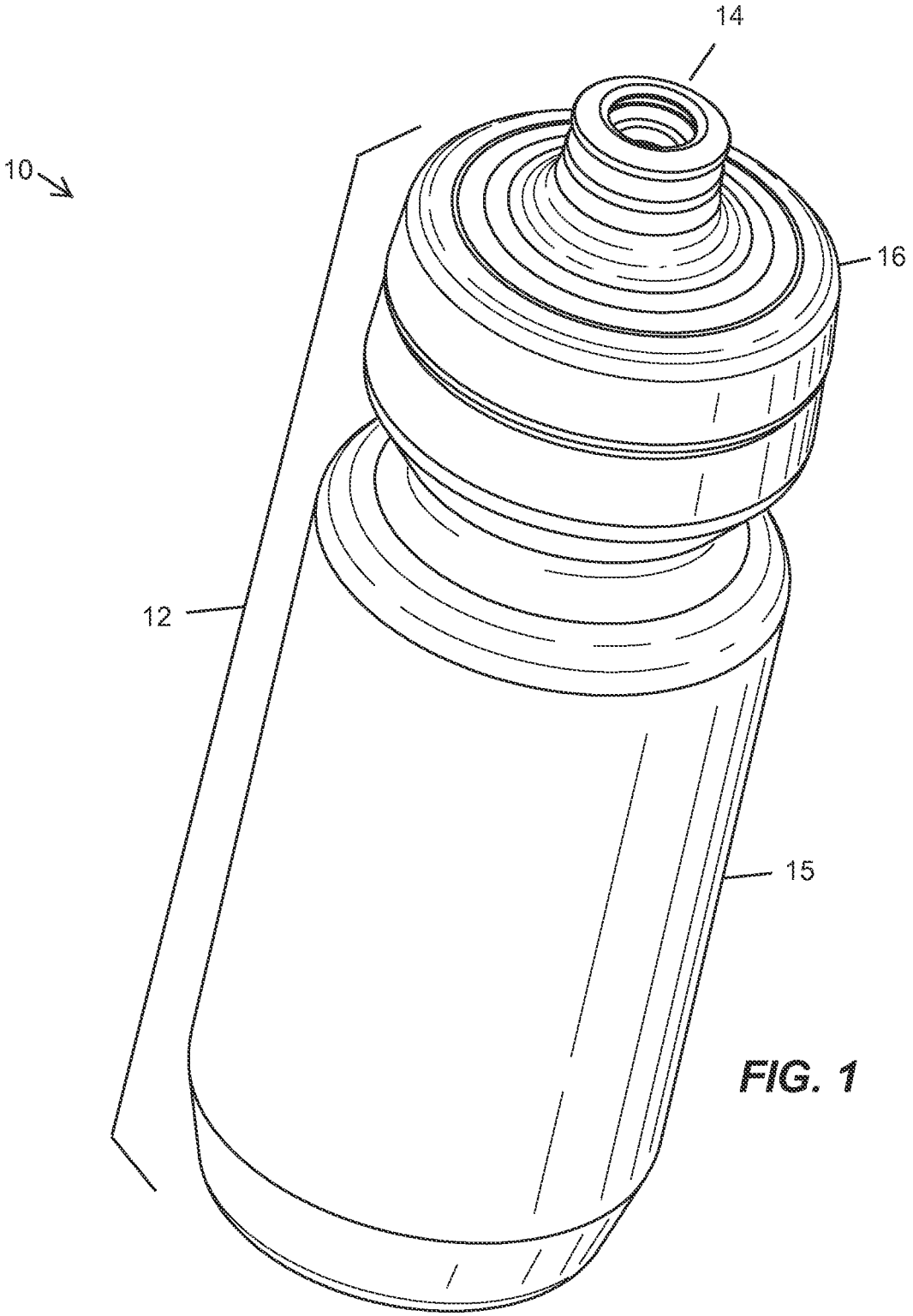
FIG. 1 is a perspective view of a water bottle embodying the present invention and including a body, a cap, and a poppet.
Figure 2:
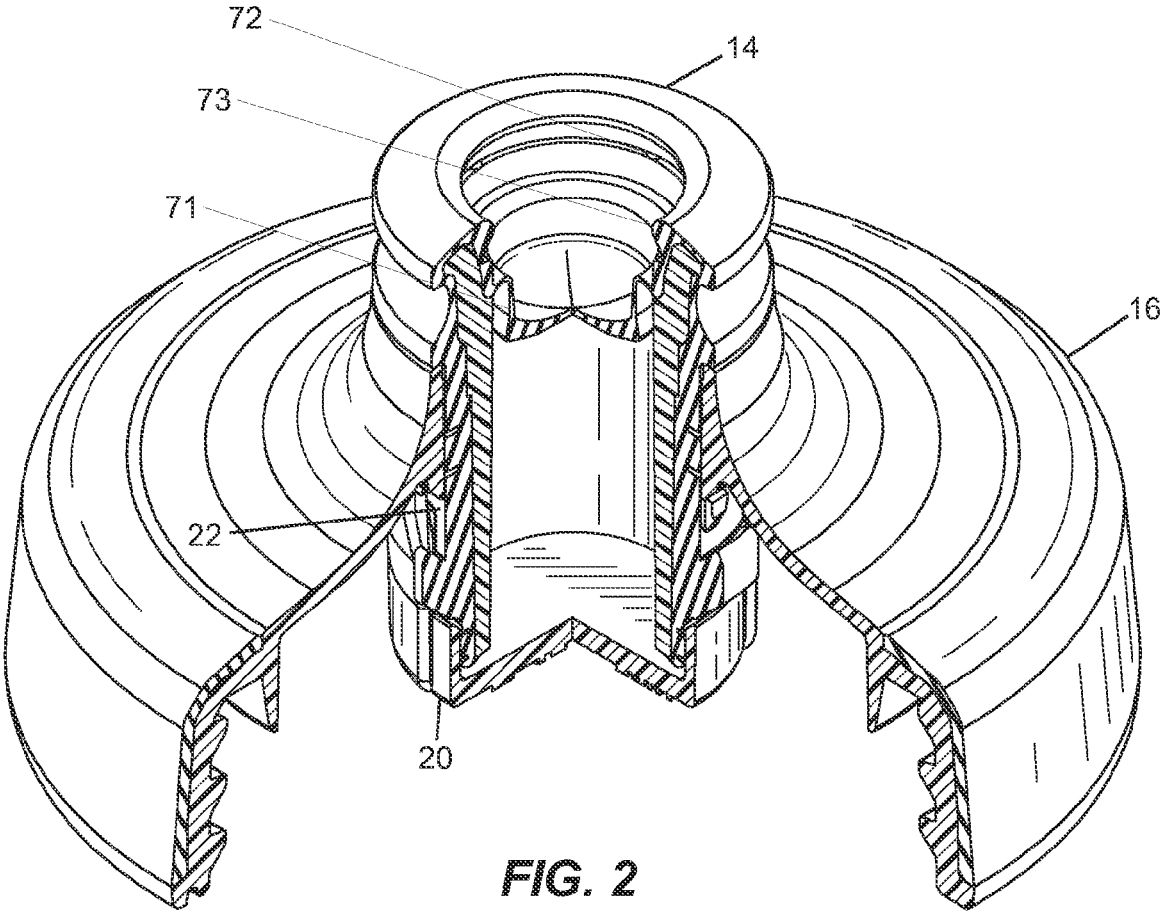
FIG. 2 is quarter section view of the cap and poppet of the water bottle of FIG. 1.
Figure 3:
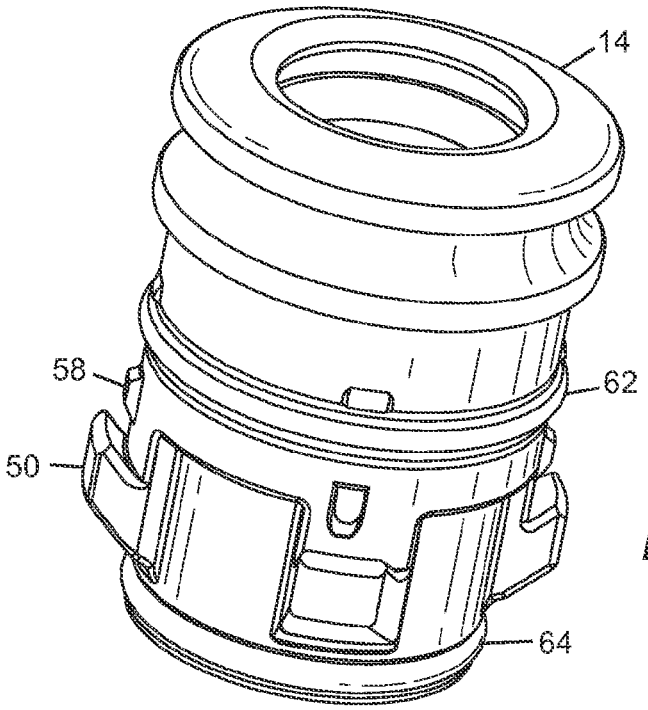
FIG. 3 is an enlarged view of the poppet of FIG. 1, including upper and lower seals and a retention cleat.
Figure 5:
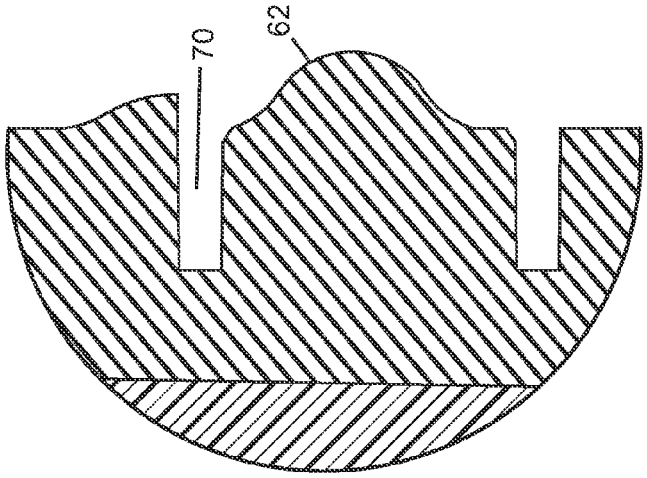
FIG. 5 is an enlarged section view of the upper seal of the poppet of FIG. 3.
Figure 6:
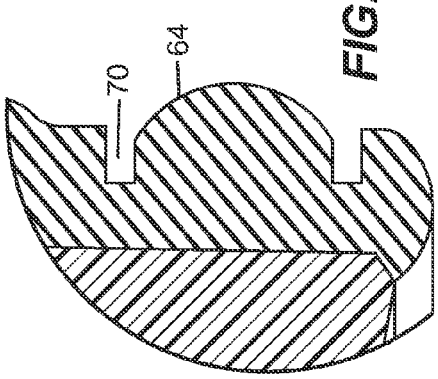
FIG. 6 is an enlarged section view of the lower seal of the poppet of FIG. 3.

FIG. 1 illustrates a liquid-dispensing container 10 including a housing 12 and a poppet 14. The illustrated housing 12 is formed from a body 15 and a cap 16 threaded onto the body 15. The cap 16 includes a central opening surrounded by a valve seat guide 20 that receives the poppet 14, as is generally known in the art. The valve seat guide 20 includes a series of four elongated openings 22 that cooperate with features on the poppet 14 to guide linear movement of the poppet 14 relative to the cap 16. The cap further includes an upper circumferential ridge 23 that cooperates with features on the poppet, as described below in more detail.

Figure 4:
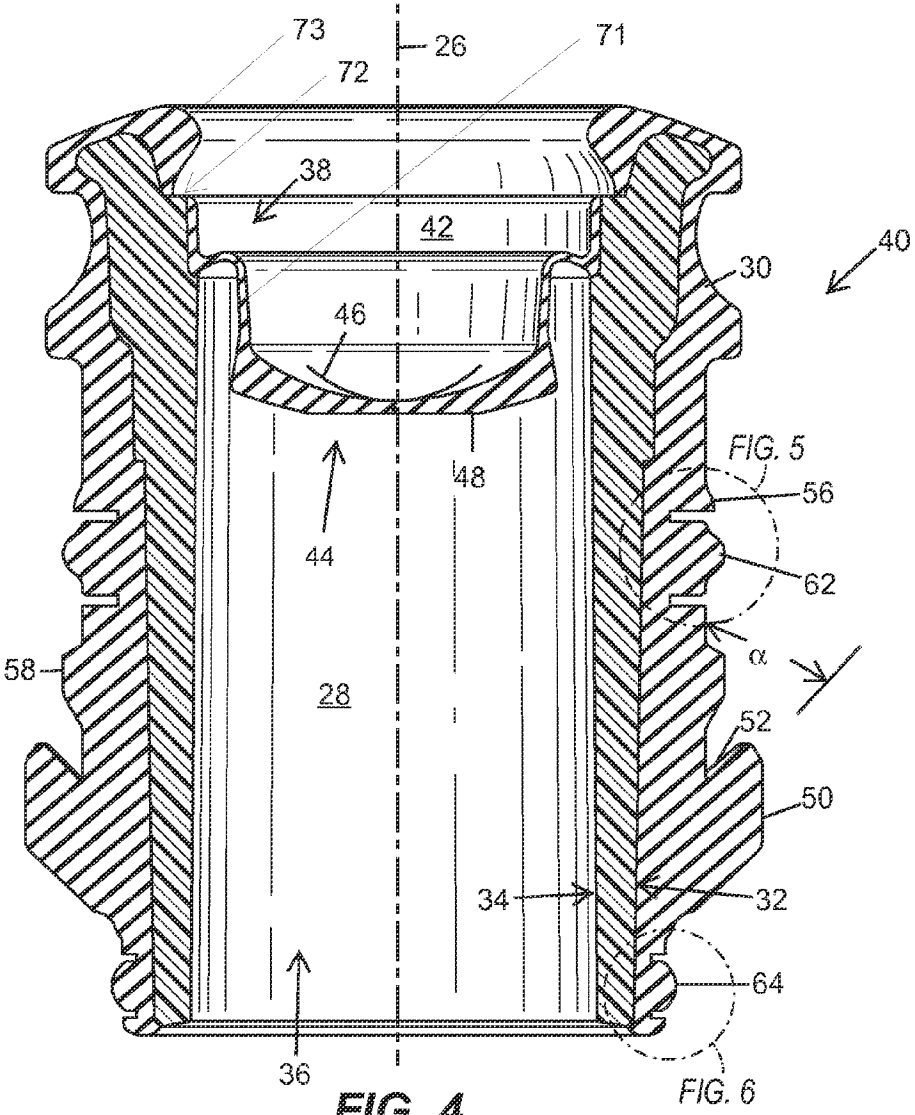
FIG. 4 is a longitudinal section view of the poppet of FIG. 3.
Figure 7:
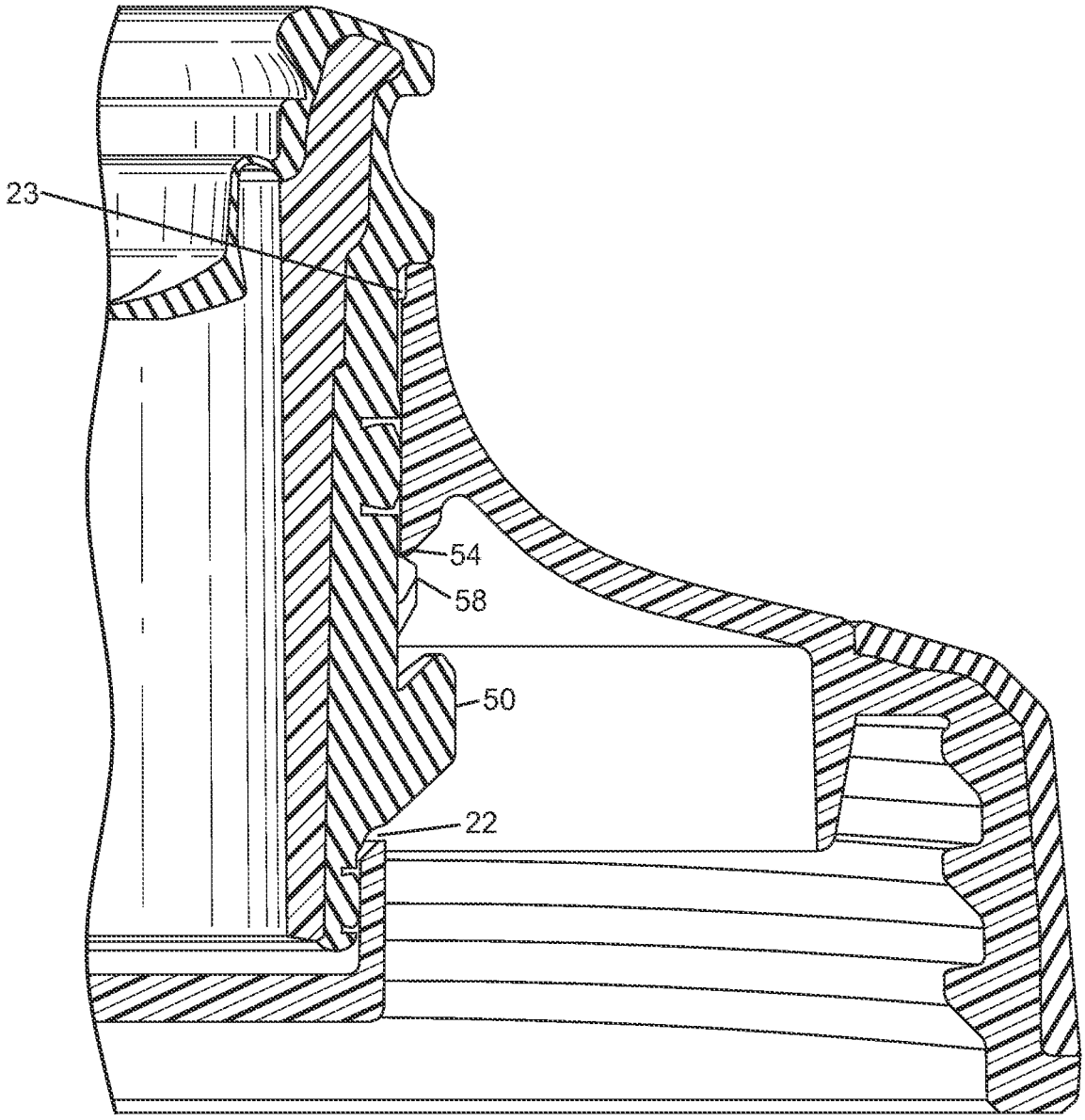
FIG. 7 is an enlarged section view of the poppet and cap of FIG. 2 in the closed position.
Figure 8:
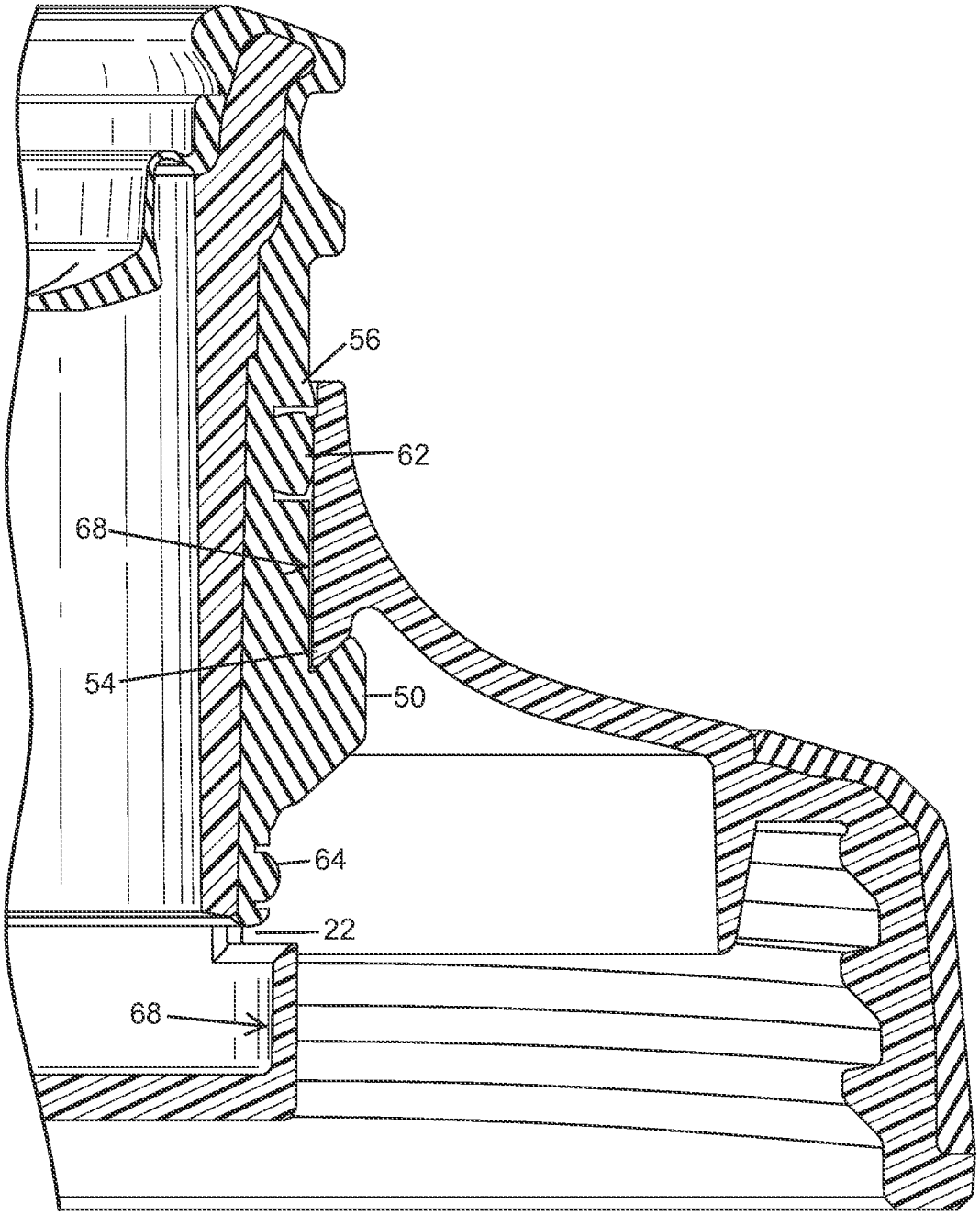
FIG. 8 is the view of FIG. 7 with the poppet in the open position.

As shown in FIG. 4, the poppet 14 includes a central axis 26. The poppet 14 is movable relative to the guide 20 along the axis 26 between a closed position (FIG. 7) and an open position (FIG. 8). The poppet 14 includes a base portion 28 and an elastomeric portion 30 co-molded over the base portion 28. The base portion 28 is a tubular structure made from a relatively stiff plastic material having a tensile modulus of elasticity of about 1,450,000 psi. The base portion 28 includes an exterior surface 32 and an interior surface 34 that defines an interior passage 36 that extends all the way through the poppet 14. The base portion 28 has a length that extends almost the entire length of the poppet 14. In the illustrated embodiment, the base portion 28 has a length that is about 95 percent of the entire length of the poppet 14.

The elastomeric portion 30 is co-molded with the base portion 28 using a material having a lower hardness and increased elasticity compared to the base portion 28. In the illustrated embodiment, the elastomeric portion 30 is made from in elastomeric material having a durometer of about Shore A 50 and a tensile modulus of elasticity of about 800 psi. The elastomeric portion 30 includes an inner section 38 and an outer section 40 integrally formed with the inner section 38. The elastomeric portion 30 contains openings 72, which expose portions of the base portion 28 that can be contacted in a direction parallel to the axis 26 to hold the base portion in the desired location within the tool while the elastomeric portion is being overmolded. These openings 72 are shielded from direct view parallel to the axis 26 by an overhanging feature 73.

The inner section 38 is engaged with and covers a relatively small section of the interior surface 34 of the upper end of the base portion 28. The result is that about 85 percent of the length of the interior surface 34 of the base portion 28 is exposed. This represents about 80 percent of the entire length of the poppet 14. The inner section 38 includes an annular portion 42 that is engaged with and is secured to (co-molded with) the interior surface 34 of the base portion 28. The inner section 38 further includes a self-closing valve 44 supported by the annular portion 42 and substantially blocking the interior passage 36 through the base portion 28. The self-closing valve 44 includes slits 46 that defined four flaps 48 that will open when sufficient pressure is applied to the valve 44. The self-closing valve also includes a cylindrical section with a tapered wall 71 to cause the valve to close in a consistent, progressive manner.

The outer section 40 completely covers the exterior surface 32 of the illustrated base portion 28 such that no part of the exterior surface 32 of the illustrated base portion 28 is exposed. The outer section 40 includes four retention cleats 50 that are dimensioned to slide within the elongated openings 22 of the valve seat guide 20 to guide the poppet 14 between the open and closed positions. Each retention cleat 50 includes a retention surface 52 that is positioned at an acute angle $\alpha$ of about 45 degrees relative to the longitudinal axis 26 of the poppet 14. Each retention cleat 50 will engage an upper edge 54 of the portion of the valve seat guide 20 that defines the corresponding elongated opening 22.

The outer section 40 further includes upper protrusions 56 and lower protrusions 58 that are adapted to act as detents to provide the user with a distinct tactile sensation when opening or closing the poppet, respectively. More specifically, referring to FIG. 8, when the poppet 14 is in the open position, the upper protrusion 56 is above the circumferential ridge 23 of the cap 16. This provides the user with a snapping sensation when the poppet is opened and inhibits movement of the poppet toward the closed position. Similarly, referring to FIG. 7, when the poppet 14 is in the closed position, the lower protrusion 58 is below the upper edge 54 of the portion of the valve seat guide 20 that defines the corresponding elongated opening 22. This provides the user with a snapping sensation when the poppet is closed and inhibits movement of the poppet toward the open position.

The outer section 40 further includes an upper circumferential seal 62 positioned adjacent a mid-portion of the poppet 14, and a lower circumferential seal 64 positioned adjacent a lower end of the poppet 14. The upper and lower circumferential seals 62,64 each include a convex surface that will slide and seal against an inner surface 68 of the sidewall of the valve seat guide 20, as a best shown in FIGS. 7 and 8. The upper and lower circumferential seals 62,64 each further include a circumferential clearance adjacent the seal in order to facilitate deformation of the seal. In the illustrated embodiment, the circumferential clearance comprises a pair of circumferential grooves 70 on opposing sides of each seal 62,64. The grooves 70 extend into the outer section 40 a distance that is at least half the thickness of the outer section 40 at the location of the grooves. The grooves 70 facilitate deformation of the corresponding seal and further provide a location for holding lubricant for the seal.

Various features and advantages of the invention are set forth in the following claims.

The invention claimed is:

1. A liquid-dispensing container comprising:

a housing adapted to hold a liquid; and a poppet mounted to the housing and movable along an axis between an open position and a closed position, wherein the poppet comprises:

a base portion comprising a relatively rigid material; and an elastomeric portion comprising an elastomeric material having a tensile elastic modulus less than 80% of the elastic modulus of the rigid material, wherein the elastomeric portion includes an outer section engaged with a radial outer surface of the base portion and an inner section forming a self-closing valve, the outer section and inner section being integrally formed, wherein the base portion and the elastomeric portion are movable to the open position relative to the housing to permit fluid flow to the self-closing valve.

2. A liquid-dispensing container as claimed in claim 1, wherein the base portion comprises a tubular structure defining the radial outer surface that is at least partially covered by the elastomeric material and an interior surface that is at least partially exposed.

3. A liquid-dispensing container as claimed in claim 1, wherein the elastomeric material has a tensile elastic modulus less than 25% of the elastic modulus of the rigid material.

4. A liquid-dispensing container as claimed in claim 1, wherein the elastomeric portion includes openings that expose surfaces of the base portion that can be contacted in the direction parallel to the axis.

5. A liquid-dispensing container as claimed in claim 1, wherein the self-closing valve includes a cyWudrical section having a tapered wall thickness.

6. A liquid-dispensing container as claimed in claim 1, wherein at least a portion of the inner section engages an interior surface of the base portion.

7. A liquid-dispensing container as claimed in claim 1, wherein the outer section includes a circumferential seal.

8. A liquid-dispensing container as claimed in claim 7, wherein the outer section further includes a circumferential clearance adjacent the circumferential seal.

9. A liquid-dispensing container as claimed in claim 8, wherein the circumferential clearance comprises a groove extending at least 50% through a thickness of the outer section.

10. A liquid-dispensing container as claimed in claim 7, wherein the circumferential seal is positioned adjacent a lower end of the base portion, and wherein the outer section further includes a second circumferential seal positioned adjacent a mid portion of the base portion.

11. A liquid-dispensing container as claimed in claim 1, wherein the outer section further includes an upper protrusion that engages an upper edge of the housing when the poppet is in the open position.

12. A liquid-dispensing container as claimed in claim 1, wherein the outer section further includes a retention cleat having a retention surface at an acute angle relative to the axis.

13. A liquid-dispensing container as claimed in claim 1, wherein the housing comprises a body and a cap attached to the body.

14. A liquid-dispensing container comprising:

a housing adapted to hold a liquid; and a poppet mounted to the housing and movable between an open position and a closed position, wherein the poppet comprises:

a base portion comprising a rigid material and having an interior surface and an exterior radial surface; and an elastomeric portion comprising an elastomeric material having a lower stiffness than the rigid material, the elastomeric portion including an inner section engaging the interior surface and an outer section integral with the inner section and engaging the exterior radial surface, the outer section defining a circumferential seal and having a circumferential clearance defined in the outer section, wherein the base portion and the elastomeric portion are movable to the open position relative to the housing to permit fluid flow through the poppet.

15. A liquid-dispensing container as claimed in claim 14, wherein the circumferential clearance is adjacent the circumferential seal.

16. A liquid-dispensing container as claimed in claim 15, wherein the circumferential clearance comprises a groove extending at least 50% through a thickness of the outer section.

17. A liquid-dispensing container as claimed in claim 14, wherein the circumferential seal is positioned adjacent a lower end of the base portion, and wherein the outer section further includes a second circumferential seal positioned adjacent a mid portion of the base portion.

18. A liquid-dispensing container comprising:

a housing adapted to hold a liquid; and a poppet mounted to the housing and movable along an axis between an open position and a closed position, wherein the poppet comprises:

a base portion comprising a rigid material; and an elastomeric portion comprising an elastomeric material having a lower rigidity than the rigid material, the elastomeric portion having an outer section engaging a radial outer surface of the base portion, the outer section including a retention cleat having a retention surface at an acute angle relative to the axis, wherein the base portion and the elastomeric portion are movable to the open position relative to the housing to permit fluid flow through the poppet.

19. A liquid-dispensing container as claimed in claim 18, wherein the outer section further includes an upper protrusion that engages an upper edge of the housing when the poppet is in the open position.

* * * * *